United States

Wolens et al.

4,447,250

May 8, 1984

[54] NOVELTY HEADBAND

[76] Inventors: John Wolens, 1000 North Lake Shore Dr., Chicago, Ill. 60611; Leon Levy, 2112 N. Sedgwick, Chicago, Ill. 60614

[21] Appl. No.: 482,094

[22] Filed: Apr. 4, 1983

[51] Int. Cl.[3] ..... A63H 29/16

[52] U.S. Cl. ..... 46/1 F; 46/1 F; 2/199

[58] Field of Search ..... 46/1 F, 44, 53, 55, 46/87, 88; 2/199, 185 R, 171, 198, 206, 422, DIG. 11; D2/230, 239, 240, 248, 250, 255, 261, 263, 431; D21/52; 273/DIG. 17, 46; 272/8 N, 8 R

[56] References Cited

U.S. PATENT DOCUMENTS

| | | | |
|---|---|---|---|
| D. 247,687 | 4/1978 | Roland | D21/1 |
| 885,802 | 4/1908 | Sterrick | 46/1 F |
| 1,214,028 | 1/1917 | Hainert, Jr. | 46/88 |
| 1,715,331 | 5/1929 | Richter | 2/185 R |
| 2,203,562 | 6/1940 | Edwards | 46/88 |
| 2,593,188 | 4/1952 | Rikelman | 46/88 |
| 2,654,973 | 10/1953 | Lemelson | 46/56 |
| 2,969,547 | 1/1961 | Dye | 46/1 F X |
| 3,031,681 | 5/1962 | Hoeflich | 2/198 |
| 3,056,969 | 10/1962 | Speros | 2/171 |
| 3,211,160 | 10/1965 | Miller | 2/198 X |
| 3,345,646 | 10/1967 | McCann | 2/199 |
| 3,360,801 | 1/1968 | Parrilla | 46/88 |
| 4,104,741 | 8/1978 | Shaw et al. | 2/185 R |
| 4,232,476 | 11/1980 | Lieberman | 46/88 |
| 4,240,224 | 12/1980 | Katzman et al. | 46/44 |

FOREIGN PATENT DOCUMENTS

| | | | |
|---|---|---|---|
| 560215 | 4/1957 | Italy | 46/44 |
| 16641 | of 1895 | United Kingdom | 46/44 |

*Primary Examiner*—Mickey Yu

*Attorney, Agent, or Firm*—Thomas G. Scavone

[57] ABSTRACT

A novelty headband including a resilient annular band having two free ends, at least one expandable member movable between a retracted position and extended position in response to differences in internal pressure, means for mounting said member to the band and having fluid transmitting means included therein, and conduit means for providing a source of pressurized fluid to said expandable member.

2 Claims, 1 Drawing Figure

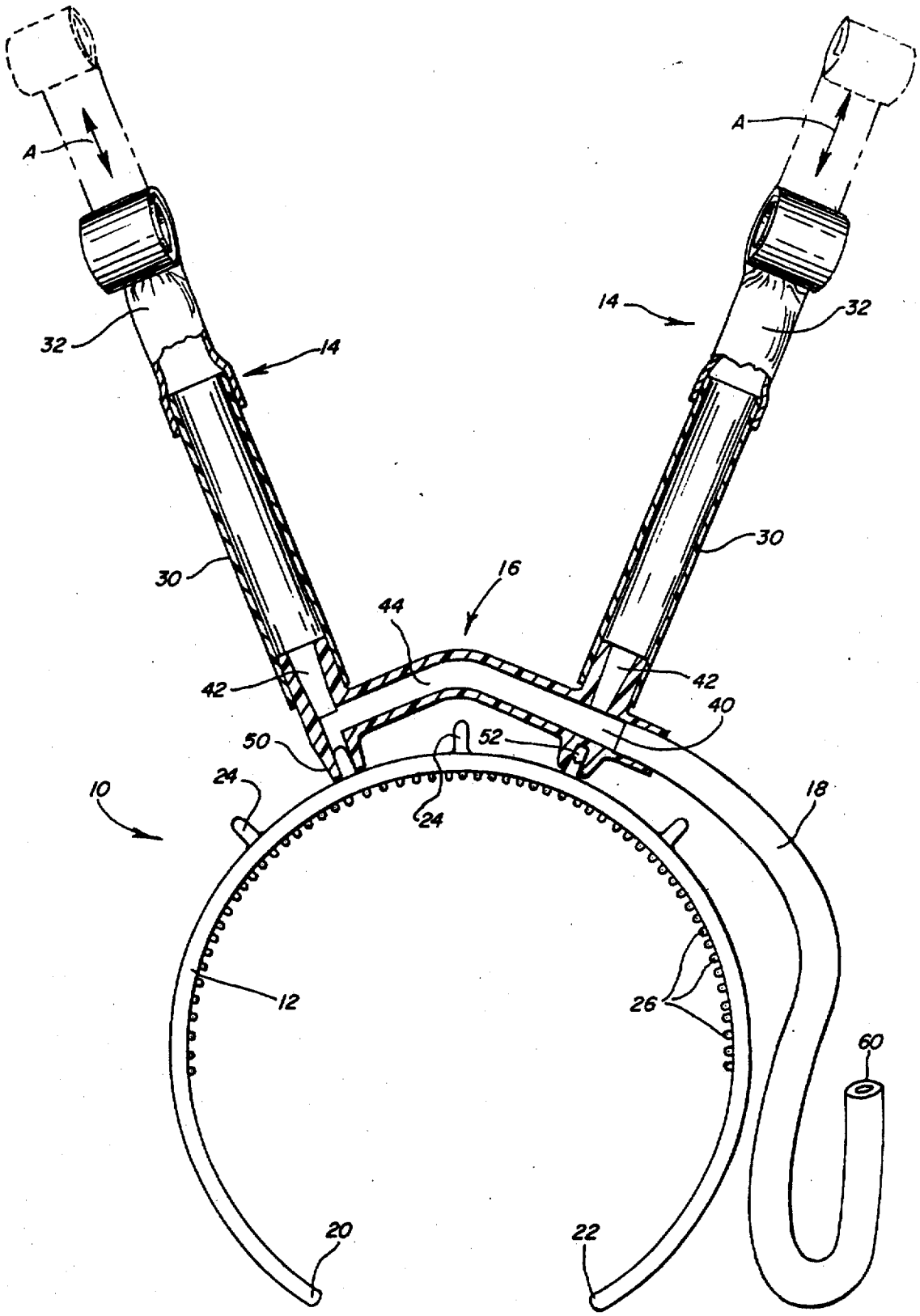
A
A
32
14
14
32
30
30
16
44
42
42
40
50
52
10
24
24
18
12
26
60
20
22

NOVELTY HEADBAND

BACKGROUND OF THE INVENTION

The present invention relates to a toy or novelty device that includes a headband and attached movable or extendable members that provide a striking or unusual visual effect when used in the intended manner.

SUMMARY OF THE INVENTION

The novelty device which embodies the features of the present invention is intended to be worn in the same fashion as a conventional headband, across the top of the head. The invention includes a resilient band, one or more expandable members that move between retracted and extended positions, a mounting means that supports the expandable members on the band and transmits fluid to and from the expandble members, and conduit means to supply a fluid under pressure to the expandable members.

BRIEF DESCRIPTION OF THE DRAWING

The novel features of the present invention are set forth in the appended claims. However, the invention will be best understood by reference to the following detailed description in connection with the drawings which depict a side elevation of the novelty device showing certain elements in cross-section for greater clarity.

DETAILED DESCRIPTION OF THE INVENTION

Referring to the drawing, the novelty device of the present invention is designated generally 10 and includes a band 12, one or more expandable members 14, means 16 for mounting the expandable members to the band 12, and conduit means 18 for supplying pressurized fluid to the expandable members.

The band 12 is generally of an annular configuration and is resilient to permit expansion of the band by separation of free ends 20 and 22. Band 12 also includes one or more outwardly extending, locating pins 24. A plurality of ridges 26 may be disposed on the inside surface of the band to help maintain its proper position on the user's head.

The expandable members 14 each include a base portion 30 and a flexible and expandable free end 32. When the pressure within members 14 is approximately atmospheric pressure, the ends 32 assume their retracted position shown in the drawings in solid lines. As the pressure increases within members 14 the free ends 32 expand and open toward their extended position shown in phantom lines in the drawings. The double-headed arrows A signify the movement of members 14 as their internal pressure varies.

The mounting means 16 is a one-piece structure, preferably constructed from injection molded plastic, and includes a manifold to distribute or transmit fluid to and from the members 14. To this end the manifold comprises an input port 40 and discharge ports 42 which are joined by a common fluid passageway 44. The input port 40 communicates or mates with conduit 18, whereas each discharge port 42 communicates or mates with one of the members 14. It may be necessary in some instances to vary the cross-sectional area of the various discharge ports 42 in order to achieve uniform movement of the members 14. For example, in the illustrated embodiment, it has been determined that the discharge port 42 at the end of mounting means 16 opposite to the input port 40 should be reduced slightly to achieve uniform movement of the two members 14.

Mounting means 16 also includes base portions 50 which have recesses or bores 52. Recesses 52 are of a size and shape to receive pins 24 in an interference fit so that mounting means 16 can be removably fixed to band 12.

The conduit 18 may be flexible plastic tubing, and should have a sufficient internal diameter to permit rapid expansion of members 14 by blowing into the free end of the conduit. Preferably, the conduit is made from an opaque plastic material.

In use, the novelty device 10 is placed on the head and fluid under pressure is introduced into the free end 60 of conduit 18. The increase in fluid pressure will cause members 14 to move from their retracted position to their extended position. When the fluid pressure is reduced, the members 14 will return to their retracted or closed position. By varying the internal pressure, the members 14 can be made to move up and down. Of course, one convenient source of pressurized fluid is the user who may blow into the free end 60 of conduit 18.

In an alternative embodiment the members 14 may include one or more small discharge holes which will permit restricted escape of pressurized fluid. Use of this arrangement with a liquid as the pressure medium will result in the discharge of one or more fine streams of liquid during use.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A novelty device including a resilient annular band having two free ends; a plurality of expandable members, each movable between a retracted position and an extended position in response to a differential in pressure within said members; a one-piece elongated mounting means secured to said band intermediate said free ends and supporting each of said expandable members, said mounting means being positioned generally adjacent and parallel to said annular band such that said expandable members are oriented generally perpendicular to said annular band; said mounting means including a manifold for transmitting fluid to and from each of the expandable members; conduit means for providing pressurized fluid to said manifold; and said manifold having one fluid input port in communication with said conduit means and a plurality of fluid discharge ports in communication with said expandable members, said input and discharge ports being joined by a common fluid passageway.

2. The novelty device of claim 1 wherein said annular band includes means for locating said mounting means at one or more circumferential positions.

* * * * *